US011420788B2

(12) United States Patent
Gilstrap et al.

(10) Patent No.: US 11,420,788 B2
(45) Date of Patent: Aug. 23, 2022

(54) COLLAPSIBLE WALL SCOOPING STORAGE SYSTEM

(71) Applicant: SNARK22, INC., Fullerton, CA (US)

(72) Inventors: Jared Matthew Gilstrap, Fullerton, CA (US); Thomas Dale Peterson, Glendora, CA (US); Pauletta Yvonne Perez, Corona, CA (US)

(73) Assignee: SNARK22, INC., Fullerton, CA (US)

( * ) Notice: Subject to any disclaimer, the term of this patent is extended or adjusted under 35 U.S.C. 154(b) by 531 days.

(21) Appl. No.: 16/237,944

(22) Filed: Jan. 2, 2019

(65) Prior Publication Data

US 2019/0256246 A1 Aug. 22, 2019

Related U.S. Application Data

(60) Provisional application No. 62/615,292, filed on Jan. 9, 2018.

(51) Int. Cl.
*B65D 6/18* (2006.01)
*B65D 6/24* (2006.01)

(52) U.S. Cl.
CPC ..... *B65D 11/1833* (2013.01); *B65D 11/1866* (2013.01)

(58) Field of Classification Search
CPC ..... B65D 11/00; B65D 11/18; B65D 11/1833; B65D 11/186; B65D 11/1866; B65D 11/1873
USPC ..... 220/7, 6, 62
See application file for complete search history.

(56) References Cited

U.S. PATENT DOCUMENTS 5,573,599 A * 11/1996 Uitz ..... B65D 11/1833 134/16
6,401,995 B1 * 6/2002 Yuille ..... B60R 7/02 220/483

* cited by examiner

*Primary Examiner* — Javier A Pagan
(74) *Attorney, Agent, or Firm* — Shimokaji IP

(57) ABSTRACT

A storage system includes a floor; a pair of end walls hingedly and detachably affixable to the floor; a pair of side walls hingedly and detachably affixable to the floor; and a cover hingedly and detachably affixable to one of the end walls.

19 Claims, 9 Drawing Sheets

COLLAPSIBLE WALL SCOOPING STORAGE SYSTEM

CROSS REFERENCE TO RELATED APPLICATIONS

This application claims the benefit of and priority to U.S. provisional application Ser. No. 62/615,292 filed Jan. 9, 2018, which is incorporated herein in its entirety.

BACKGROUND OF THE INVENTION

The present invention generally relates to storage systems and, more particularly, to apparatus and methods of storage with detachable and collapsible components.

There is a need for improved apparatus and methods to store and use items within the confines of a storage container. There is a further need to store the storage containers.

SUMMARY OF THE INVENTION

In one aspect of the present invention, a storage system comprises a floor; a pair of end walls hingedly and detachably affixable to the floor; a pair of side walls hingedly and detachably affixable to the floor; and a cover hingedly and detachably affixable to one of the end walls.

In another aspect of the present invention, a storage system comprises a floor having a floor mating portion; a pair of end walls; wherein at least one end wall has a first end wall mating portion; wherein the first end wall mating portion has one of a first end wall protrusion configuration and a first end wall receptacle configuration; wherein the at least one end wall is hingedly and detachably affixable, at the first end wall mating portion, to the floor, at the floor mating portion; a pair of side walls affixable to the floor; and a cover affixable to one of the end walls.

In a further aspect of the present invention, a storage system comprises a floor having, at a peripheral edge thereof, a floor mating portion having one of a floor protrusion configuration and a floor receptacle configuration; a pair of end walls detachably affixable, at the floor mating portion, to the floor; a pair of side walls; wherein at least one side wall has a side wall mating portion; wherein the side wall mating portion has one of a side wall protrusion configuration and a side wall receptacle configuration; wherein the at least one side wall is hingedly and detachably affixable, at the side wall mating portion, to the floor, at the floor mating portion; a cover hingedly and detachably affixable to one of the end walls.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, the present invention provides apparatus and methods of storing items, such as toys, arts and craft materials, tools, and hardware. In the present invention, a storage system may include modular components that may be detachable from one another to facilitate stacking and storing the modular components. Also, according the present invention, the modular components may remain attached, but they can be repositioned in a single planar configuration that forms a single planar surface. The single planar surface may then be used by the user, such as placing the stored items on the single planar surface.

In embodiments, the modular components can be made by plastic injection molding. Thereby, "living" hinges can be incorporated into the modular components.

FIGS. 1A-1D depict a storage system 100 according to embodiments of the present invention. In such embodiments, the system 100 can transform itself among different configurations between closed and opened positions.

Figure 1A:
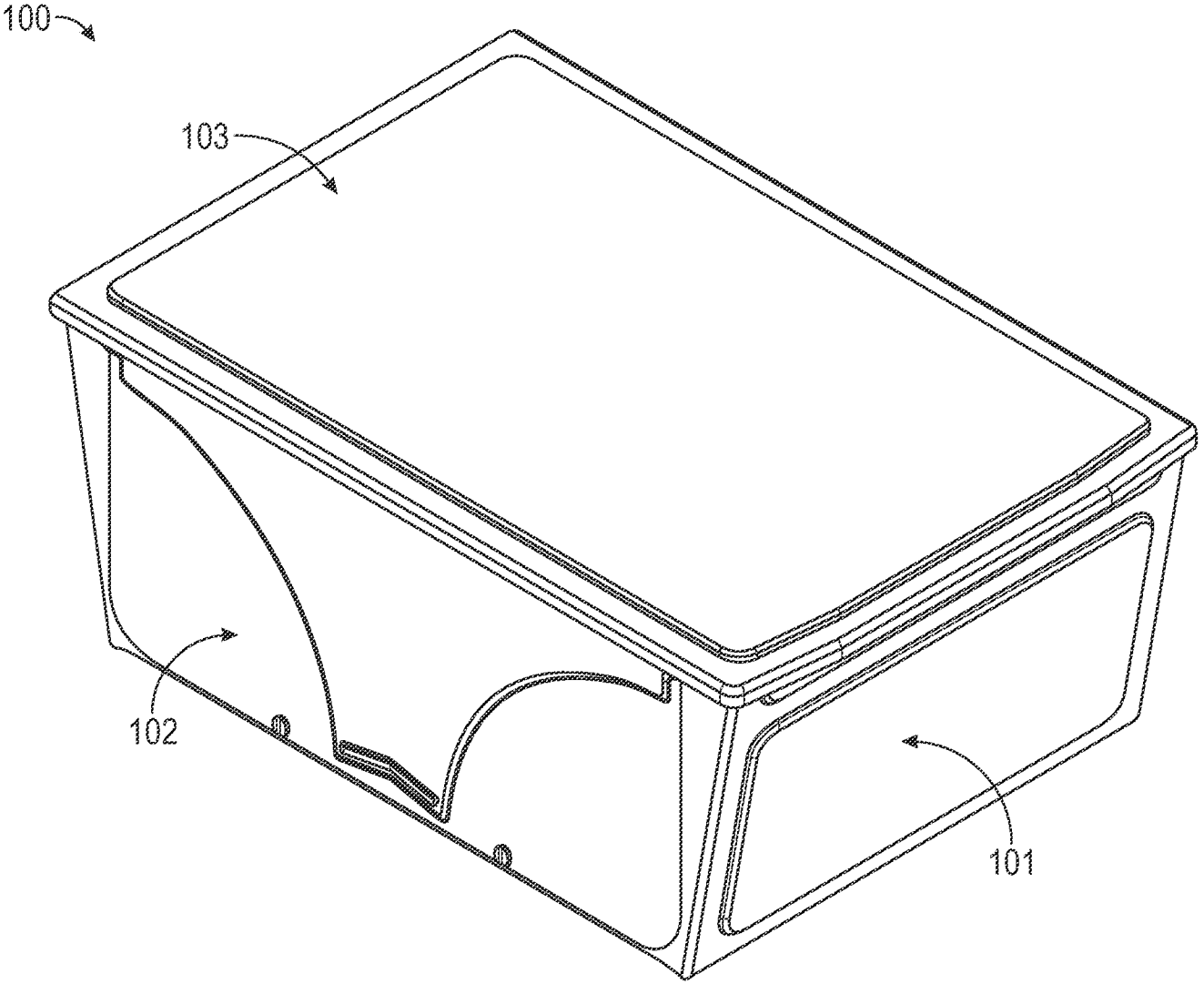
FIG. 1A is a perspective view of a storage system according to an embodiment of the present invention.

FIG. 1A shows the storage system 100 in a closed position or configuration. As shown, the storage system 100 can include two end walls (i.e., components or modules) 101 (only one of which is shown), two side walls (i.e., components or modules) 102 (only one of which is shown), and a cover (i.e., component or module). The cover 103 is shown in a closed position or configuration to contain or store items within the storage system 100.

Figure 1B:
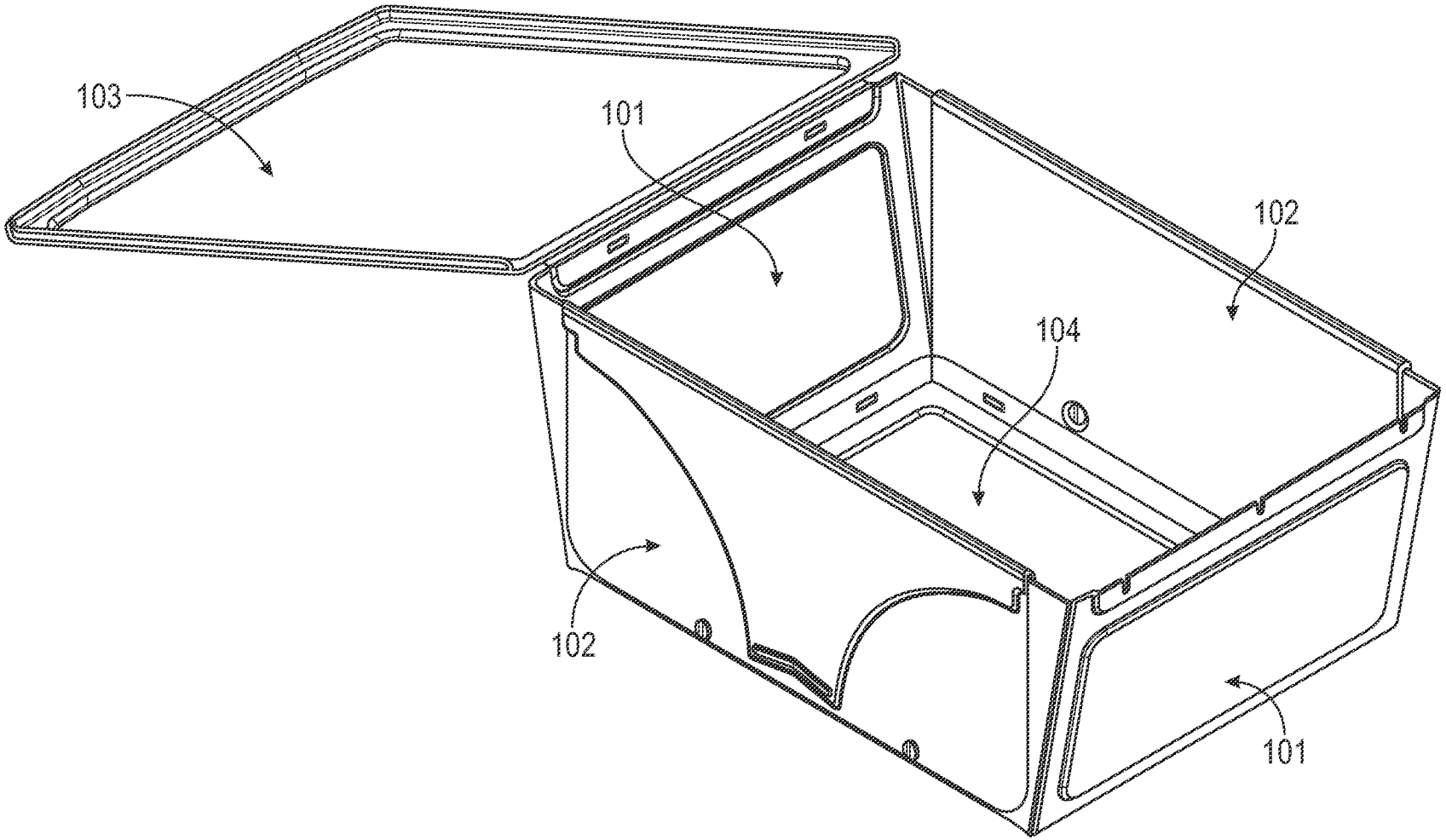
FIG. 1B is a perspective view of the storage system of FIG. 1A with a cover opened.

FIG. 1B shows the storage system 100 in a partially open position or configuration. As shown, the storage system 100 can further include a floor (i.e., component or module) 104 which is hingedly and detachably affixable to the end walls 101 and the side walls 102. "Hingedly and detachably affixable" is intended to mean that two components or modules can be affixed to and detached from one another and, when affixed to one another, rotate relative to one another as if affixed with a hinge. The cover 103 is shown in a partially open position or configuration to expose the items within the storage system 100. As also shown, the end walls 101 and the side walls 102 are partially separated from each other. More specifically, the end walls 101 have moved from an essentially 90 degree angle from the floor 104 (FIG. 1A) to an obtuse angle, as measured between the floor 104 and each end wall 101. Thus, the end walls 101 are also in partially open positions or configurations.

Figure 1C:
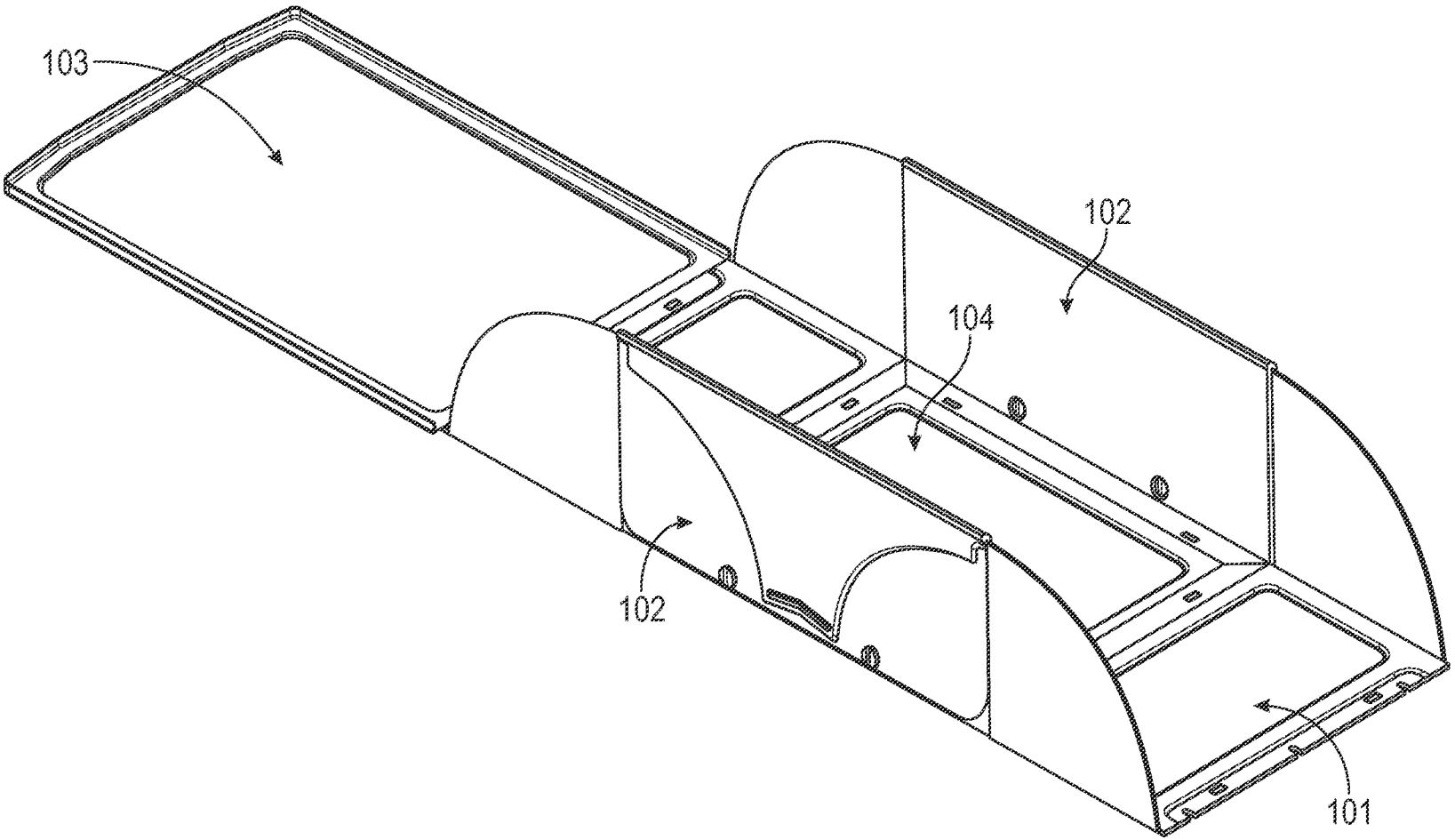
FIG. 1C is a perspective view of the storage system of FIG. 1A with a cover, floor, and two side walls in a use position.

FIG. 1C shows the storage system 100 in a more fully but still partially open position or configuration. As shown, the cover 103 is flat on a surface supporting the system 100. Thus, the cover 103 is parallel to and 180 degrees to the floor 104. Further, the end walls 101 have moved from an obtuse angle (FIG. 1B) to an essentially 180 degree angle, as measured between the floor 104 and each end wall 101. Thus, the end walls 101 are in more fully but still partially open positions or configurations. Additionally, the side walls 102 are oriented essentially 90 degrees to the floor 104, as shown.

Figure 1D:
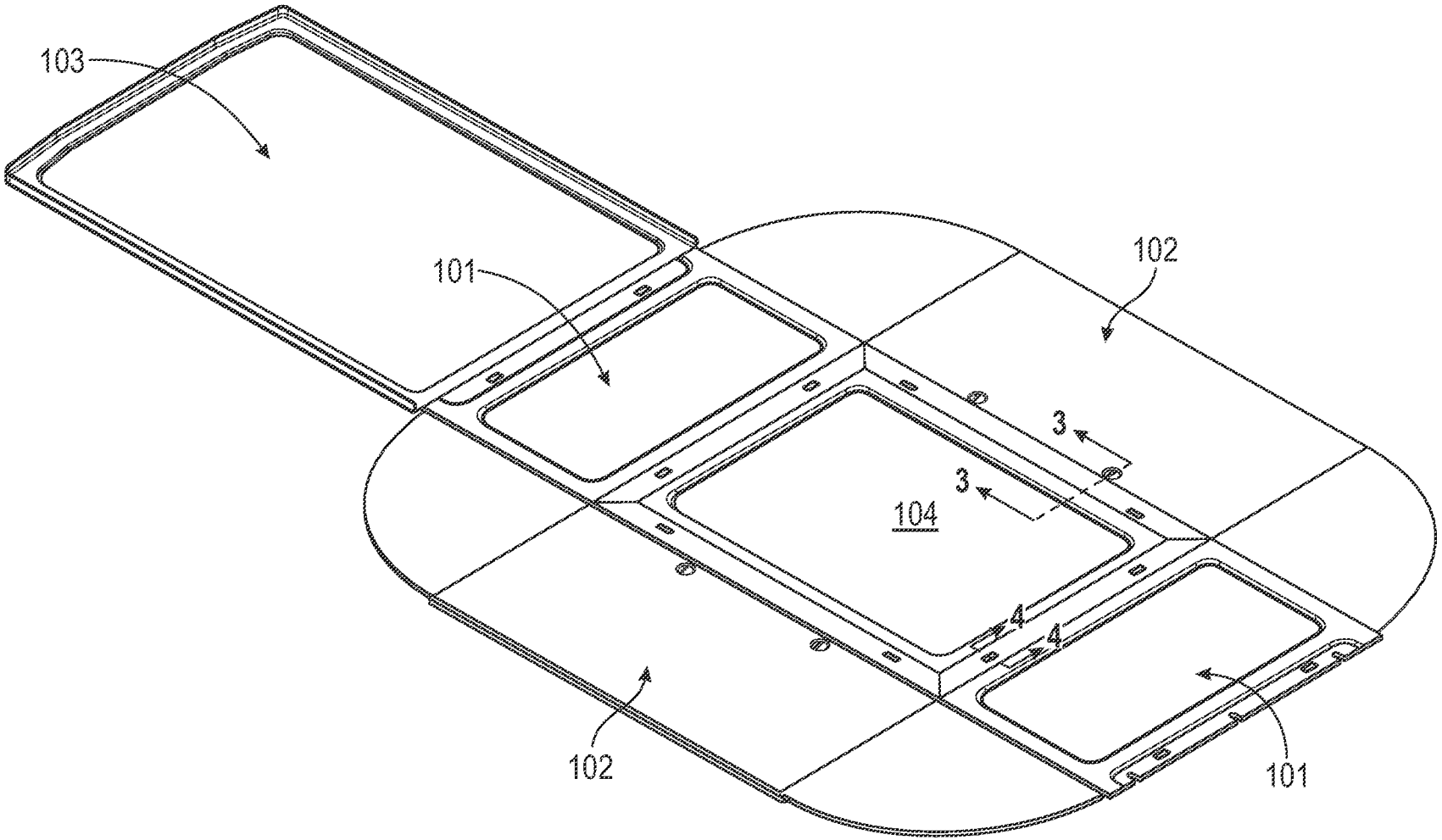
FIG. 1D is a perspective view of the storage system of FIG. 1A with a cover, floor, two end walls, and two side walls in a use or planar position.

FIG. 1D shows the storage system 100 in a completely open position or configuration. In such position, all components or modules of the system 100 are flat on a surface supporting the system 100. In other words, all components or modules of the system 100 lie in a single plane. In such planar or use position or configuration, the system 100 exposes the stored items to a user. And the user may use the stored items on a single planar surface provided by all of the components or modules.

As further described below, the floor 104 is hingedly and detachably affixable to the end walls 101 and to the side walls 102 so that the walls 101, 102 can move between their closed positions and their completely open positions. And, of course, the walls 101, 102 can move back from their completely open positions to their completely closed positions.

Figure 2:
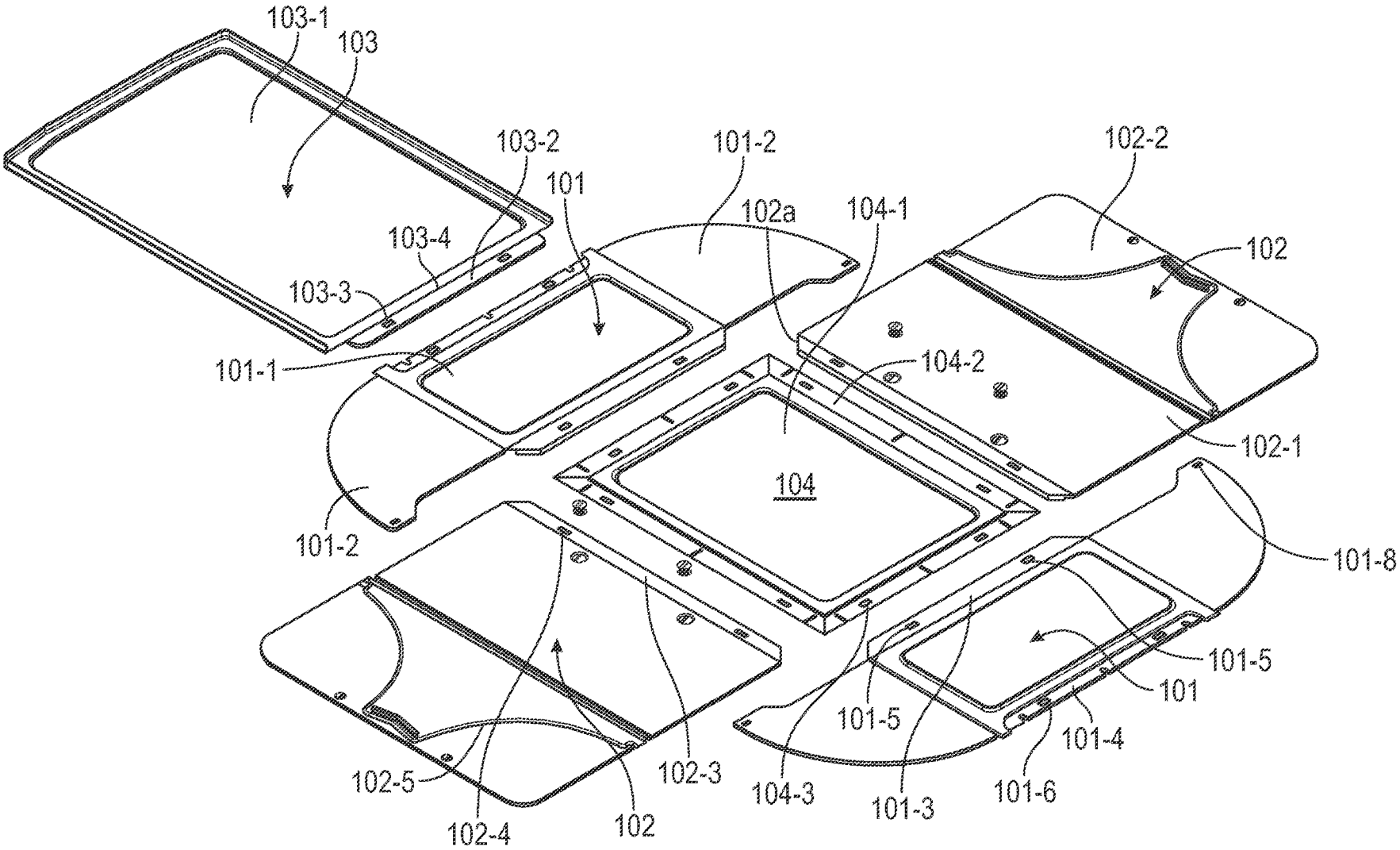
FIG. 2 is a perspective, exploded view of FIG. 1D.

In FIG. 2, each end wall 101 may have a central portion 101-1 and a pair of curved end or corner portions 101-2 hingedly affixed, via a hinge 101-9 (FIG. 6), on opposed sides of the central portion 101-1. Each end portion 101-2 may have at a distal end thereof a protrusion 101-8. Each end wall 101 may further have on opposing edges of the central portion 101-1 a first end wall mating portion 101-3 and a second end wall mating portion 101-4. The first mating portion 101-3 can be hingedly affixed, via a hinge 101-7 (FIG. 6), to the central portion 101-1, and may have a first end wall protrusion (i.e., male) configuration or a first end wall receptacle (i.e., female) configuration. One or more first end wall protrusions or receptacles 101-5 may be disposed in the first end wall mating portion 101-3.

In the embodiment of FIG. 2, the first mating portion 101-3 has a receptacle configuration and thus 101-5 is a receptacle or slot. Similarly, the second mating portion 101-4 may have a second end wall protrusion (i.e., male) configuration or a second end wall receptacle (i.e., female) configuration. One or more second end wall protrusions or receptacles 101-6 may be disposed in the second end wall mating portion 101-4. In the embodiment of FIG. 2, the second mating portion 101-4 has a protrusion configuration and thus 101-6 is a protrusion or tab.

Still in FIG. 2, each side wall 102 may have a central portion 102-1 and, hingedly attached thereto, via a hinge 102-8 (FIG. 7), a slotted portion 102-2 and a partial wall 102-7. The slotted portion 102-2 and the partial wall 102-7 may form a slot 102-5 between them. The slot 102-5 may receive the end portions 101-2 of the end walls 101. The partial wall 102-7 may have a receptacle 102-10 that may receive the protrusions 101-8. Each central portion 102-1 may have on an edge opposite the slotted portion 102-2 a side wall mating portion 102-3 hingedly affixed, via a hinge 102-9 (FIG. 7), to the central portion 102-1. The side wall mating portion 102-3 may have a side wall protrusion (i.e., male) configuration or a side wall receptacle (i.e., female) configuration. One or more side wall protrusions or receptacles 102-4 may be disposed in the side wall mating portion 102-3. In the embodiment of FIG. 2, the side wall mating portion 102-3 has a receptacle configuration and thus 102-4 is a receptacle or slot.

Continuing in FIG. 2, the cover 103 may have a central portion 103-1 and, at a perimeter edge of the central portion 103-1, a cover mating portion 103-2 hingedly affixed, via a hinge 103-4, to the central portion 103-1. The cover mating portion 103-2 may have a cover protrusion (i.e., male) configuration or a cover receptacle (i.e., female) configuration. One or more cover protrusions or receptacles 103-3 may be disposed in the cover mating portion 103-2. In the embodiment of FIG. 2, the cover mating portion 103-2 has a receptacle configuration and thus 103-3 is a receptacle or slot.

In FIG. 2, the floor 104 may have a central portion 104-1 and, at and along an entire perimeter edge of the central portion 104-1, a floor mating portion 104-2. The floor mating portion 104-2 may have a floor protrusion (i.e., male) configuration or a floor receptacle (i.e., female) configuration. One or more floor protrusions or receptacles 104-3 may be disposed in the floor mating portion 104-2. In the embodiment of FIG. 2, the floor mating portion 104-2 has a protrusion configuration and thus 104-3 is a protrusion or tab.

As can be appreciated, the floor mating portion 104-2 can be hingedly and detachably affixable to the end wall mating portions 101-3, to the side wall mating portions 102-3, and to the cover mating portion 103-2. If the floor mating portion 104-2 has a protrusion (i.e., male) configuration, the end wall portions 101-3, the side wall mating portions 102-3, and the cover mating portion 103-2 can have receptacle (i.e., female) configurations. Or, the configurations can be reversed.

Figure 3:
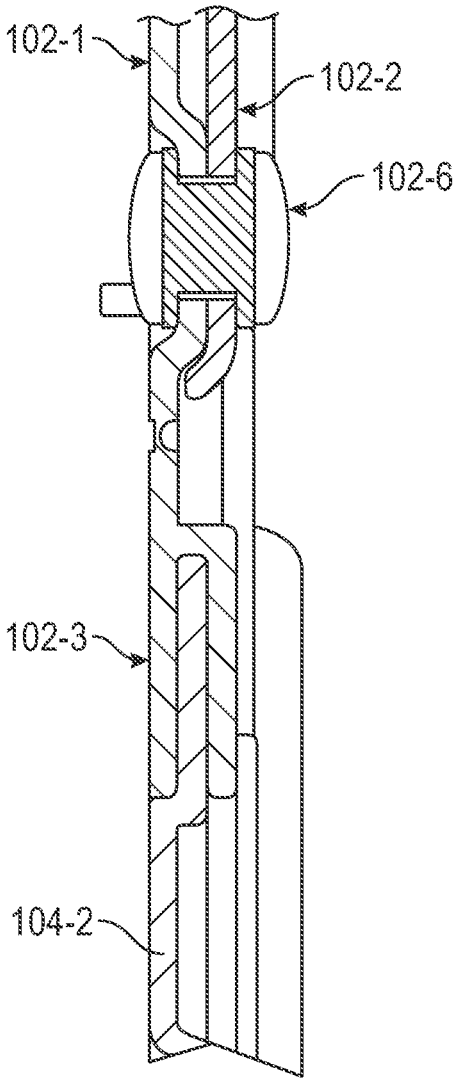
FIG. 3 is a cross-sectional view taken along line 3-3 of FIG. 1D.

FIG. 3 is an enlarged cross-sectional view of line 3-3 in FIG. 1D. The side wall has its slotted portion 102-2 folded back against its central portion 102-1 (not shown). A fastener 102-6 can fix the slotted portion 102-2 to the central portion 102-1.

Figure 4:
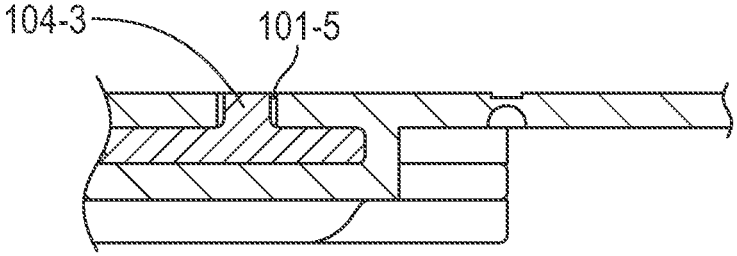
FIG. 4 is a cross-sectional view taken along line 4-4 of FIG. 1D.

FIG. 4 is an enlarged cross-sectional view of line 4-4 in FIG. 1D. The receptacle or slot 101-5 of the side wall 101 has received the protrusion or tab 104-3 of the floor 104.

Figure 5A:
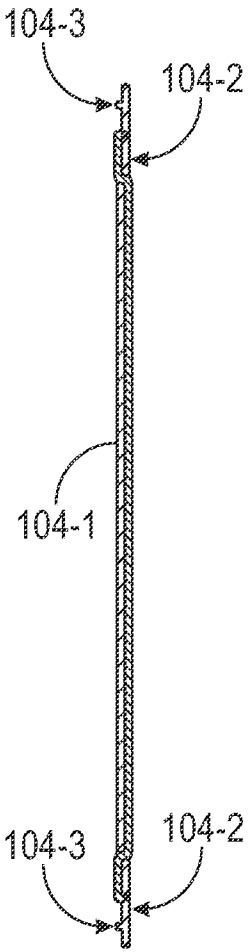
FIG. 5A is a cross-sectional view taken along line 5A-5A of FIG. 5.
Figure 5:
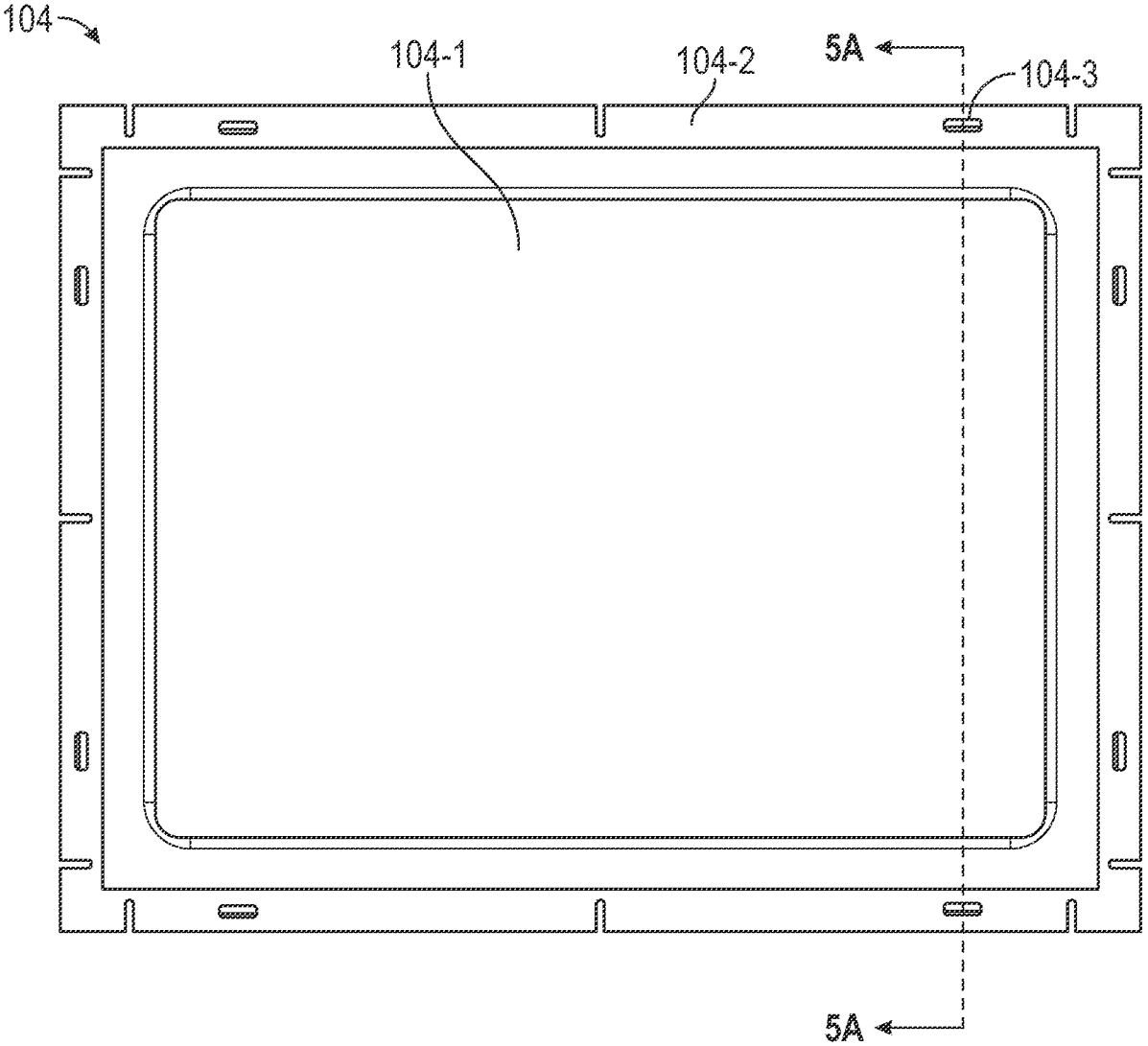
FIG. 5 is a planar view of the floor in FIG. 1D.

FIG. 5 is a planar view of the floor 104. FIG. 5A is a cross sectional view of line 5A-5A in FIG. 5. In FIG. 5A, the floor mating portion 104-2 has a plurality of receptacles or slots 104-3 that can mate with the end wall mating portion 101-3, the side wall mating portion 102-4, and the cover mating portion 103-2.

Figure 6A:
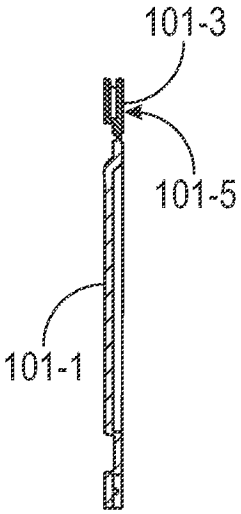
FIG. 6A is a cross-sectional view taken along line 6A-6A of FIG. 6.
Figure 6:
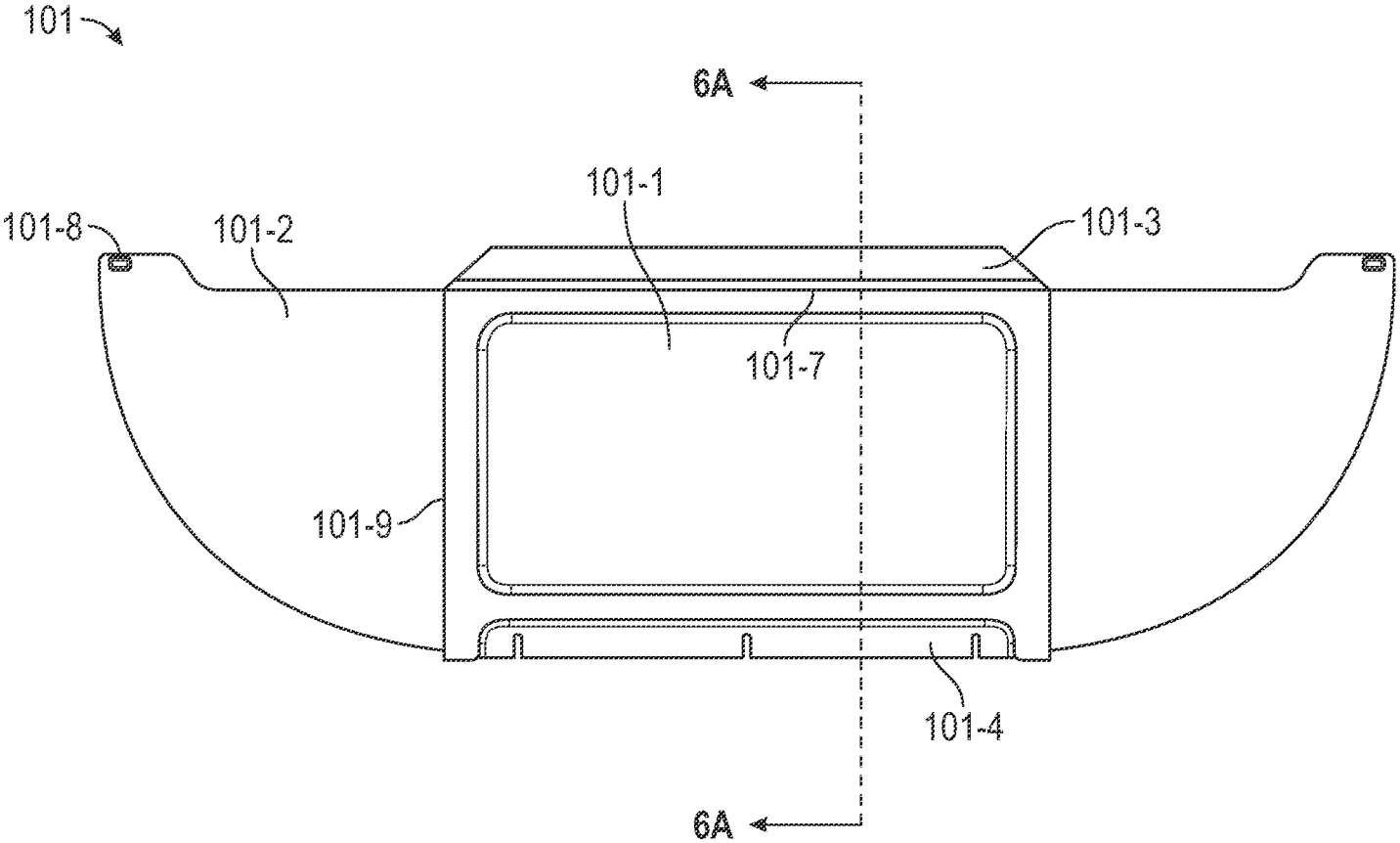
FIG. 6 is a planar view of an end wall in FIG. 1D.

FIG. 6 is a planar view of the end wall 101. FIG. 6A is a cross sectional view of line 6A-6A in FIG. 6. In FIG. 6A, the end wall mating portion 101-3 has a receptacle or slot 101-5 that can mate with the floor mating portion 104-2.

Figure 7A:
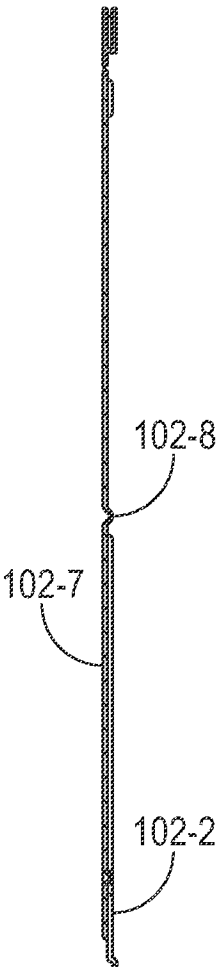
FIG. 7A is a cross-sectional view taken along line 7A-7A of FIG. 7.
Figure 7:
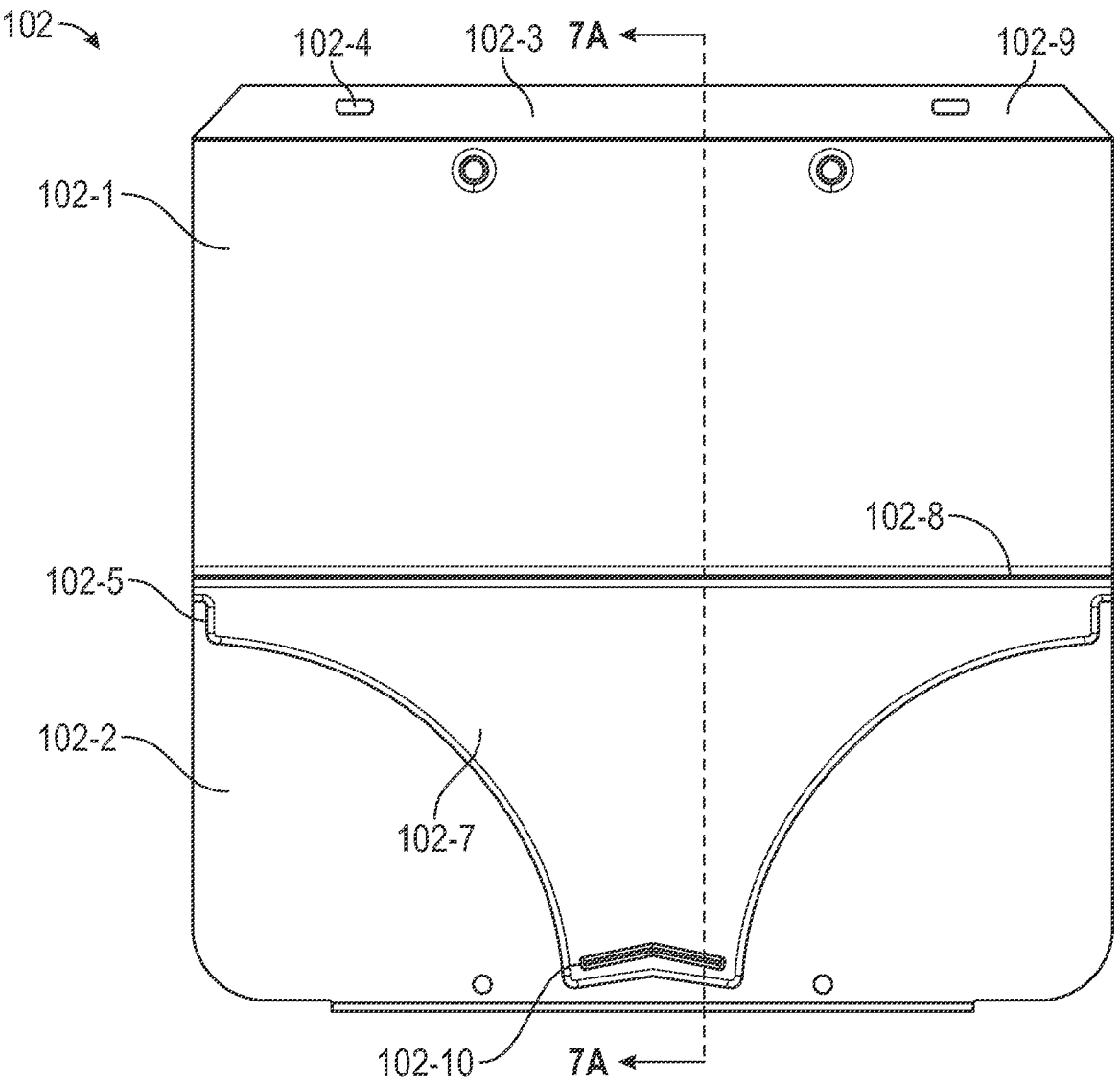
FIG. 7 is a planar view of a side wall in FIG. 1D.

FIG. 7 is a planar view of the side wall 102. FIG. 7A is a cross sectional view of line 7A-7A in FIG. 7. In FIG. 7A, the central portion 102-1 is hinged, via a side wall hinge 102-8, to the slotted portion 102-2. The end wall mating portion 102-3 has a plurality of receptacles or slots 102-4 that can mate with the floor mating portion 104-2.

As can be appreciated, when the modular components of the system 100 are in a single planar surface with stored items on the planar surface, the items can be gathered up by folding up the end and side walls.

It should be understood, of course, that the foregoing relates to exemplary embodiments of the invention and that modifications may be made without departing from the spirit and scope of the invention as set forth in the following claims.

We claim:

1. A storage system, comprising:

a floor;

a pair of end walls hingedly and detachably affixable to the floor;

a pair of side walls hingedly and detachably affixable to the floor;

wherein at least one of the side walls has a side wall central portion and a slotted portion;

wherein the side wall central portion and the slotted portion are hingedly affixed to one another whereby the side wall central portion and the slotted portion can be positioned in a back-to-back orientation;

wherein the slotted portion is configured to receive at least one of the end walls; and a cover hingedly and detachably affixable to one of the end walls.

2. The system of claim 1, wherein the floor includes a floor central portion and a floor mating portion at an edge of the floor central portion.

3. The system of claim 2, wherein the floor mating portion is disposed about an entirety of a perimeter edge of the floor central portion.

4. The system of claim 2, wherein the floor mating portion has a protrusion configuration.

5. The system of claim 1, wherein at least one of the end walls has an end wall receptacle portion.

6. The system of claim 1, wherein at least one of the side walls has a side wall receptacle portion.

7. The system of claim 1, wherein the cover has a cover receptacle portion.

8. A storage system comprising:

a floor having a floor mating portion;

a pair of end walls;

wherein at least one of the end walls has a first end wall mating portion;

wherein the first end wall mating portion has one of a first end wall protrusion configuration and a first end wall receptacle configuration;

wherein the at least one end wall is hingedly and detachably affixable, at the first end wall mating portion, to the floor, at the floor mating portion;

a pair of side walls affixable to the floor;

wherein at least one of the side walls has a side wall central portion, a slotted portion, and a partial wall;

wherein the side wall central portion and the slotted portion are configured to rotate into a back-to-back orientation;

wherein the slotted portion and the partial wall form a slot therebetween;

wherein the slot is configured to receive at least one of the end walls; and a cover affixable to one of the end walls.

9. The system of claim 8, wherein the floor mating portion extends along a perimeter edge of the floor.

10. The system of claim 8, wherein the at least one end wall has an end wall central portion and a pair of end portions on opposed sides of the end wall central portion.

11. The system of claim 8, wherein the at least one end wall has a second end wall mating portion, wherein the second end wall mating portion has one of a second end wall protrusion configuration and a second end wall receptacle configuration.

12. The system of claim 8, wherein at least one of the side walls has a side wall mating portion, wherein the side wall mating portion has one of a side wall protrusion configuration and a side wall receptacle configuration.

13. The system of claim 8, wherein the cover is hingedly and detachably affixable to the at least one end wall.

14. A storage system, comprising:

a floor having, at a peripheral edge thereof, a floor mating portion having one of a floor protrusion configuration and a floor receptacle configuration;

a pair of end walls detachably affixable, at the floor mating portion, to the floor;

a pair of side walls;

wherein at least one of the side walls has a side wall mating portion;

wherein the side wall mating portion has one of a side wall protrusion configuration and a side wall receptacle configuration;

wherein the at least one side wall is hingedly and detachably affixable, at the side wall mating portion, to the floor, at the floor mating portion;

wherein the at least one side wall has a side wall central portion, a slotted portion, and a partial wall;

wherein side wall central portion and the slotted portion are hingedly affixed to one another to rotate into a back-to-back orientation;

wherein the slotted portion and the partial wall form a slot therebetween;

wherein the slot is configured to receive at least one of the end walls; and a cover hingedly and detachably affixable to one of the end walls.

15. The system of claim 14, wherein the floor has a floor central portion and the floor mating portion extends about the floor central portion.

16. The system of claim 14, wherein the pair of end walls are hingedly and detachably affixable to the floor.

17. The system of claim 14, wherein the pair of side walls are hingedly and detachably affixable to the floor.

18. The system of claim 14, wherein at least one of the end walls has a curved end portion.

19. The system of claim 18, wherein the slot is configured to receive the curved end portion.

* * * * *